US007562500B2

(12) United States Patent
Siu

(10) Patent No.: US 7,562,500 B2
(45) **Date of Patent: *Jul. 21, 2009**

(54) COMPOSITE STEEL JOIST/COMPOSITE BEAM FLOOR SYSTEM AND STEEL STUD WALL SYSTEMS

(76) Inventor: Wilfred Wing-Chow Siu, 8411 - 42 Avenue, Edmonton, Alberta (CA) T6K 1C9

( * ) Notice: Subject to any disclaimer, the term of this patent is extended or adjusted under 35 U.S.C. 154(b) by 476 days.

This patent is subject to a terminal disclaimer.

(21) Appl. No.: 11/112,911

(22) Filed: Apr. 25, 2005

(65) Prior Publication Data

US 2006/0236628 A1 Oct. 26, 2006

(51) Int. Cl.
*E04H 12/02* (2006.01)

(52) U.S. Cl. ..... 52/236.6; 52/236.7; 52/236.3; 52/241; 52/319

(58) Field of Classification Search ..... 52/274, 52/236.7, 236.3, 236.5, 236.8, 236.6, 241, 52/332, 319, 337
See application file for complete search history.

(56) References Cited

U.S. PATENT DOCUMENTS

| | | | | | |
|---|---|---|---|---|---|
| 1,958,473 | A | * | 5/1934 | Dovell | 52/73 |
| 2,211,384 | A | * | 8/1940 | Patterson | 52/263 |
| 2,641,449 | A | * | 6/1953 | Antony | 165/49 |
| 3,568,388 | A | * | 3/1971 | Flachbarch et al. | 52/588.1 |
| 3,680,271 | A | * | 8/1972 | Satchell | 52/656.1 |
| 3,952,462 | A | * | 4/1976 | Heise | 52/62 |
| 4,056,908 | A | | 11/1977 | McManus | |
| 4,078,347 | A | * | 3/1978 | Eastman et al. | 52/302.3 |
| 4,182,080 | A | * | 1/1980 | Naylor | 49/410 |
| 4,189,883 | A | | 2/1980 | McManus | |
| 4,432,178 | A | | 2/1984 | Taft | |
| 4,486,993 | A | | 12/1984 | Graham et al. | |
| 4,597,233 | A | | 7/1986 | Rongoe, Jr. | |
| 4,653,237 | A | | 3/1987 | Taft | |
| 4,741,138 | A | | 5/1988 | Rongoe, Jr. | |
| 4,805,364 | A | * | 2/1989 | Smolik | 52/241 |
| 4,809,476 | A | * | 3/1989 | Satchell | 52/241 |

(Continued)

FOREIGN PATENT DOCUMENTS

| | | |
|---|---|---|
| CA | 1186910 | 5/1985 |

(Continued)

*Primary Examiner*—Phi Dieu Tran A
(74) *Attorney, Agent, or Firm*—Donald V. Tomkins

(57) ABSTRACT

This invention reveals new metal stud perimeter wall and load-bearing wall systems that support, without eccentricity, concrete-topped floors on open-web-steel-joists, deep-profiled composite metal decks and channel-shaped joists and allow upper floor framing to complete before floor concreting; a new composite steel beam for open-web-steel-joist support; a new shear-connection-ready open-web-steel joist; and a new perimeter metal stud wall system that incorporates an in-wall wheel-stopper. The new wall systems incorporate web-perforated studs, and/or web-perforated tracks doubling as concrete closures, and other concrete closure devices. The composite beam incorporates shear connectors protruding through a special web-perforated track fitted with a load-bearing block and cutouts in the legs for open-web-steel-joist support. Unlike composite open-web-steel joists supporting simple-span metal decks, the new shear-connection-ready joist incorporates a flat-topped chord to allow continuous steel deck layout and field-installed shear connectors. The new joists are best used with medium-depth wide-fluted composite floor deck for maximum system efficiency.

5 Claims, 9 Drawing Sheets

U.S. PATENT DOCUMENTS

| | | | | | |
|---|---|---|---|---|---|
| 5,113,631 | A | * | 5/1992 | diGirolamo et al. | 52/236.8 |
| 5,291,717 | A | * | 3/1994 | Turner | 52/745.07 |
| 5,544,464 | A | | 8/1996 | Dutil | |
| 5,669,194 | A | * | 9/1997 | Colasanto et al. | 52/236.8 |
| 5,782,047 | A | | 7/1998 | De Quesada | |
| 5,787,665 | A | | 8/1998 | Carlin et al. | |
| 5,822,940 | A | | 10/1998 | Carlin et al. | |
| 5,881,516 | A | | 3/1999 | Luedtke | |
| 5,983,577 | A | | 11/1999 | Hays | |
| 6,050,045 | A | | 4/2000 | Campbell | |
| 6,263,628 | B1 | | 7/2001 | Griffin | |
| 6,276,094 | B1 | | 8/2001 | Hays | |
| 6,293,057 | B1 | | 9/2001 | Amos Hays | |
| 6,298,617 | B1 | | 10/2001 | de Quesada | |
| 6,318,044 | B1 | | 11/2001 | Campbell | |
| 6,389,778 | B1 | | 5/2002 | Strange | |
| 6,983,569 | B1 | * | 1/2006 | Rosenberg | 52/241 |

FOREIGN PATENT DOCUMENTS

| | | | | |
|---|---|---|---|---|
| CA | 1251056 | | 3/1989 | |
| CA | 2441737 | | 3/2004 | |
| GB | 2157336 | * | 10/1985 | 52/241 |

* cited by examiner

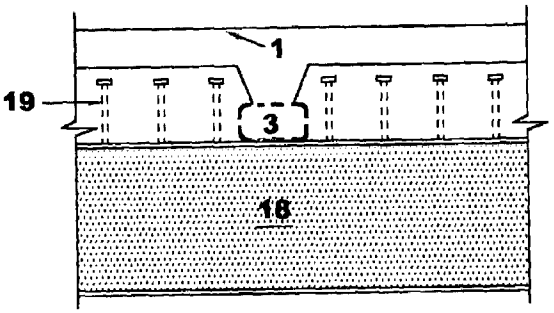
FIG 6A
FIG 6B
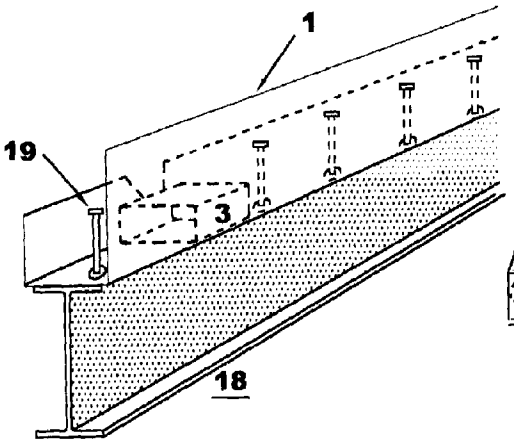
FIG 6C
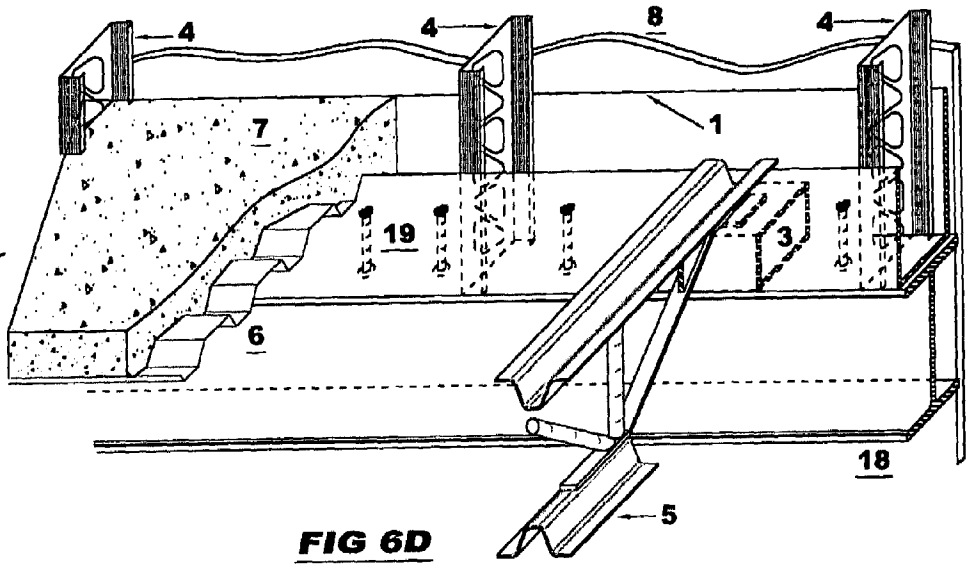
FIG 6D

COMPOSITE STEEL JOIST/COMPOSITE BEAM FLOOR SYSTEM AND STEEL STUD WALL SYSTEMS

REFERENCE TO SEQUENCE LISTING, A TABLE, OR A COMPUTER PROGRAM LISTING COMPACT DISC APPENDIX

Not Applicable

BACKGROUND OF THE INVENTION

Load-Bearing Wall Construction

In conventional construction of multi-storey structures comprising load-bearing walls, platform framing technique is used. As the name suggests, platform framing relies on the floor assembly to provide a platform for subsequent framing construction. The lower floor supporting elements, usually the load-bearing walls, are constructed, then the floor elements installed, directly bearing on the supporting elements below. The follow-up bearing walls are then constructed, followed by the next upper floor assembly. The process repeats itself until the roof elements are installed. All modern floor systems involve the use of concrete as an integral part of the floor assembly. The fact that subsequent floor construction follows the completion of the floor assembly below means a significant delay in waiting for the concrete to cure.

Attempts have been made to eliminate/minimize the delay in platform construction. U.S. Pat. No. 4,486,993 by Graham et al, No. 5,881,516 by Luedtke, and U.S. Pat. No. 5,782,047 as well as U.S. Pat. No. 6,298,617 by de Quesada, deal, in varying degrees, with methods of constructing bearing walls whereby the upper wall assembly can proceed before completion of the floor elements.

The first one, U.S. Pat. No. 4,486,993 by Graham et al, employs hot rolled angles attached to a foam-core latticed bearing wall for floor assembly support.

U.S. Pat. No. 5,782,047 by de Quesada employs hot rolled ledge angles attached to light gauge C-shaped channel steel stud bearing walls for bearing support of the concrete-topped floor assemblies. Floor concrete may terminate at the sides of the load-bearing walls, or may be carried continuously between the upper and lower wall assemblies. In the latter case (with concrete running between upper and lower assemblies), the upper wall assembly is supported on equally spaced screw-jack assemblies allowing the upper wall assembly to proceed before the floor concrete.

In U.S. Pat. No. 6,298,417, de Quesada refined his earlier invention and discarded the use of hot rolled ledge angles for floor support, and screw-assemblies as spacers to allow continuity of the concrete in the floor. In place of the hot-rolled ledge angles, a hat section is placed on top of the lower wall panel, with legs projecting horizontally out to support floor joists. In place of screw-jack assemblies, discrete connectors are used. These connectors are shop-welded to the bottom of the upper wall panel, and site welded to the top of the bottom panel.

U.S. Pat. No. 5,881,516 by Luedtke deals with load bearing wall systems wherein the axial load does not pass through the floor assembly. Wall systems include both wood and conventional steel stud bearing walls. Floor assemblies include wood joists, light gauge steel C-joists, and low-profile composite steel decks. The floor assemblies are supported, outside of the plane of the bearing wall, by various metal devices.

Underlying all of the above-referenced U.S. Patent Documents is the premise of carrying the floor load outside of the plane of the bearing wall. This very premise, however, creates eccentricity in the loading, and significantly reduces the load carrying capacity of the bearing wall. Both Luedtke (U.S. Pat. No. 5,981,516) and de Quesada (U.S. Pat. Nos. 5,782,047 and 6,298,417) deals with shallow floor assemblies, i.e. low-profile floor decks (less than 76 mm in depth) and C-joists. The more common steel floor systems with OWSJ and medium/deep (in excess of 76 mm in depth) profile composite-floor-decks are not discussed. With significantly increased spans associated with these more common systems, the eccentric bearing details become costly and complicated.

While continuity of the concrete in the floor assembly is maintained within the plane of the load bearing walls to maintain continuous inter-floor fire and acoustic separation across the bearing walls, neither Luedtke (U.S. Pat. No. 5,881,516) nor Graham (U.S. Pat. Nos. 5,782,047 and 6,298,417) makes structural use of the concrete. Hence, secondary structural elements are still required over window or door openings in the wall panels.

This invention will present metal stud load-bearing wall systems that

- Permit upper floor-wall assemblies to proceed prior to installing floor concrete;
- Support metal C-joists, open web steel joists, deep profile steel decks (over 50 mm in depth) without eccentric loading; and,
- In the case of the load-bearing walls supporting OWSJ and C-joists, embody a reinforced concrete beam at the floor level as part of the wall systems Composite Beam Supporting Open Web Steel Joists In post-and-beam construction with OWSJ's, floor joists bear directly on the supporting beams, thus creating a space between the floor concrete and the supporting beams. This bearing detail is the only reason precluding the use of composite beam construction in the steel-joist-on-beam construction.

Rongoe (U.S. Pat. No. 4,741,138 and Canadian Patent 1,230,495) solved this problem by providing extensions from the girder, through the decking and into the concrete, in an assembly utilizing girders, standard joists bearing on top of the girders, and metal decking onto which concrete is poured. The extensions are located in between open web steel joists. The shear headed studs are field welded to the extensions through holes cut in the steel deck.

The limitations of this composite girder are:

- The thickness of cover concrete available for composite action; and
- Expense of the extension and the amount of welding required for composite action.

This invention provides an intermediate bearing element to support the joists and allows for the floor concrete to be in full contact with the steel beam along the full length of the beam. Instead of merely adding a thin concrete deck acting compositely with the steel beam, this invention provides a deep concrete section (T-section for interior beam and L-section for perimeter beam, respectively) to act integrally with the steel beam. This invention allows shop installation of headed studs to the beam for better quality control.

Shear-Connection-Ready Open Web Steel Joists

Concrete-topped steel deck on open web steel joists constitutes the most common steel floor system. Many attempts have been made to further the efficiency of the system by integrating the open web steel joists with the concrete on the steel deck for composite action.

McManus (U.S. Pat. No. 4,189,883), and Moreau (Canadian Patent Documents 2,441,737 and 2,404,535) reveal means of integrating the top chord of open web steel joists and/or trusses with the concrete deck for improved horizontal shear resistance.

Dutil (U.S. Pat. No. 5,544,464), Taft (U.S. Pat. Nos. 4,653,237 and 4,432,178, and Canadian Patent 1,208,030), and Gjelsvik et al (Canadian Patents 1,251,056 and 1,186,910) all present composite open web steel joist systems working in concert with concrete-topped steel decks for greater gravity load-carrying capacity. This invention is mainly concerned with the gravity load-carrying capacity of the composite open web steel joist system.

In Dutil's system, each joist has a top chord forming a shear connector protruding into the concrete deck. Forming part of the top chord are two angles acting as shelves to receive steel decking. The deck acts as a form for pouring the slab, and is a permanent part of the composite floor system. Dutil's system is commercially marketed under the name of Hambro joists by Canam.

Taft introduced a secondary truss-type framing member in which the top chord of the truss is formed in the shape of a modified "I" section having an upper flange, web and lower flange for supporting steel decking. The upper flange and web of the top chord are totally embedded in the concrete to cause the concrete floor and steel truss to function together structurally as a composite system.

Gjelsvik et al proposed open web steel joists with the top chord comprising a pair of steel angles, and web members extending between the steel angles to the top of the vertical legs of the steel angles. Decking is supported by the horizontal legs of the top chord of adjacent joists and a concrete slab poured on the decking and between the vertical legs of the top chord to provide bonding between the concrete slab, top chord and web.

All the above systems exhibit the common features:

Steel deck is supported by shelves forming part of the joist top chord, and is discontinuous over the joist.

Composite action is achieved by embedding the top chord in the concrete, which acts as a continuous shear connector.

The use of shelves (usually in the form of angles) for deck support increases the cost of the composite open web joist system in several ways:

Expensive shelve angles

Discontinuous steel deck

Excessive connections over joist support

Slower deck installation

This invention will show how the expensive shelves (usually in the form of angles) may be eliminated and the continuity of the steel deck maintained with field-installed discrete shear connectors onto a new type of shear-connection-ready OWSJ.

Perimeter Stud Walls With Improved Impact Resistance

In post-and-beam construction, perimeter walls are often in-filled walls with metal studs. The in-fill walls are normally deigned against wind loads only. In load-bearing metal stud wall construction, the perimeter walls are designed for gravity load as well as wind loads. In either case, perimeter stud walls are not designed for errant vehicles running into buildings. This invention will show an economical method of constructing perimeter metal stud walls with improved resistance to impact from errant vehicles.

BRIEF SUMMARY OF THE INVENTION

For multi-storey buildings, this invention introduces three new types of light gauge steel load-bearing wall systems for supporting concrete topped floors, a composite steel beam system supporting concrete topped floors on OWSJ, a new type of Composite Open Web Steel Joists. In addition, this invention introduces a method of constructing vehicle-proof perimeter light gauge steel stud walls.

The LBW systems support the following floor assemblies: concrete-topped floor on Open-Web-Steel-Joists (OWSJ), concrete-topped floor on channel-type light gauge joists with perforated webs, and concrete-filled deep-profile composite floor deck, respectively. Light gauge steel studs in this invention have at least one hole at the bottom at specified locations, and may have perforations along the length of the studs.

Specialized bottom tracks and/or concrete enclosure panels are at the heart of the new LBW systems of this Invention. For LBW systems supporting channel-type light gauge joists with perforated webs, as well as mid- and deep-profile steel decks, the bottom tracks are complete with perforations in the web, and work with enclosure panels as forming for an in-wall concrete beam. For LBW supporting OWSJ, the specialized bottom track is complete with flange cutouts and discrete load-bearing blocks for OWSJ support, and works as forming for an in-wall concrete beam.

The new composite steel beam system incorporates, on the top flange of the beam, a specialized perforated track complete with cutouts and discrete load-bearing blocks for OWSJ support, and evenly spaced holes in the track for the passage of shear connectors shop or site welded to the beam.

The new Composite Open Web Steel Joist system employs a steel cap plate fitted on top of the top chord of conventional open web steel joists and shear connectors are field installed after steel deck is in place. The field-installed shear connectors may be conventional headed shear studs, or shear connectors connected with power-actuated tools. As the shear connectors are field installed after the decking is in place, this new Composite Open Web Steel Joist system maintains the continuity of the steel deck over the joists. The new Composite Open Web Steel Joist system may be used together with the Composite Steel Beam and LBW systems in this Invention, or may be used with conventional beam or LBW supports.

In load-bearing-wall construction, the objectives of the invention are:

1. To allow the upper floor framing to proceed prior to the pouring of floor concrete;
2. To provide a continuous reinforced concrete beam around the perimeter, and under load-bearing walls and demising walls for added strength and rigidity and increased inter-floor and inter-suite sound and fire separation;
3. To substantially increase load-bearing capacity and stiffness of the bearing wall by encasing the bottom of the studs in concrete, and
4. To provide anchorage against uplift at the floor elevation.

With steel beams supporting concrete-topped floor on OWSJ, the objectives of the invention are:

1. To allow building enclosure to proceed prior to the pouring of floor concrete;
2. To provide a continuous reinforced concrete beam around the perimeter for added strength and rigidity and increased inter-floor and inter-suite sound and fire separation;
3. To substantially increase the performance of the wind-bearing metal stud wall by encasing the bottom of the studs in concrete,
4. To eliminate secondary structural members normally required to stiffen the perimeter walls under long row windows, and
5. To make possible the use of composite steel beam construction for supporting concrete-topped floor on OWSJ's.

With the new Shear-Connection-Ready Open Web Steel Joists, the objectives of the invention are:

1. Increasing the joist capacity through composite construction,
2. Allowing continuity of steel deck over joist supports and thus greater economy and faster installation of steel deck, and,
3. Easy adaptability to any type of conventional OWSJ and shop practice.

With the new impact-resistant Perimeter Stud Wall System, the objective of the invention is to provide an economical in-wall concrete wheel-stop along the perimeter of the building to provide improved resistance to vehicular impacts.

BRIEF DESCRIPTION OF THE SEVERAL VIEWS OF THE DRAWING

FIGS. 6A, 6B, and 6C show the sectional view, the elevation view, and the isometric view, respectively, of exterior composite beam for the support of concrete-topped steel deck on OWSJ floor assembly—hereinafter referred as embodiment 6—at a floor joint of a multi-storey structure. FIG. 6D shows an isometric view of a typical intermediate floor/wall joint detail comprising embodiment 6 in conjunction with the "concrete-topped steel deck" floor system.

LIST OF REFERENCE NUMERALS UTILIZED IN THE DRAWING

Figure 1B:
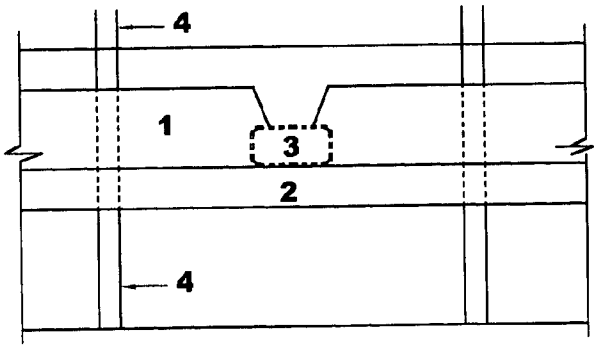
FIGS. 1A, 1B, and 1C show the sectional view, the elevation view, and the isometric view, respectively, of exterior load-bearing wall panels for the support of concrete-topped steel deck on OWSJ floor assembly—hereinafter referred as embodiment 1—at a floor joint on the perimeter of a multi-storey structure.

1. Exterior closure track for LBW-OWSJ system
2. Top track
3. Load bearing block
4. Perforated Steel stud (or stud with hole at bottom)
5. Open web steel joist
6. Metal deck
7. Concrete
8. Exterior sheathing
9. Interior closure track for LBW-OWSJ system
10. Bottom track with perforations in the web
11. Deep profile composite deck
12. Closure panel for deep profile composite deck
13. Reinforcing bar
14. Solid web rim joist
15. Web blocking for concrete stop
16. Web-perforated C-joists
17. Closure panel for C-joists
18. Steel beam
19. Shear connector
20. Left-in-place formwork
21. Foundation and slab concrete
22. Medium depth (75 mm) wide-fluted metal deck
23. Shear-connection ready OWSJ
24. Shear-connection ready OWSJ (alternate)

DETAILED DESCRIPTION OF THE INVENTION

While the subsequent descriptions of this invention are necessarily given in connection with specific apparatus and embodiments, it is to be clearly understood that this description is made only by way of example and not as a limitation to the scope of the invention. Specifically, concrete stops and closures, other than those described below and in the Drawing, can be easily developed for other types of joist floor systems.

Load-Bearing Wall (LBW) Systems

Embodiment 1—Exterior LBW for OWSJ

The first level of a load-bearing wall structure is the conventional load-bearing wall, with light gauge steel studs placed between top and bottom tracks.

Figure 1A:
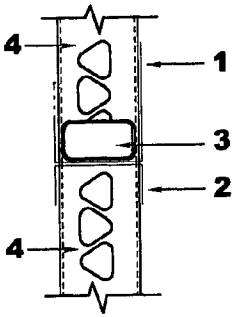
Figure 1D:
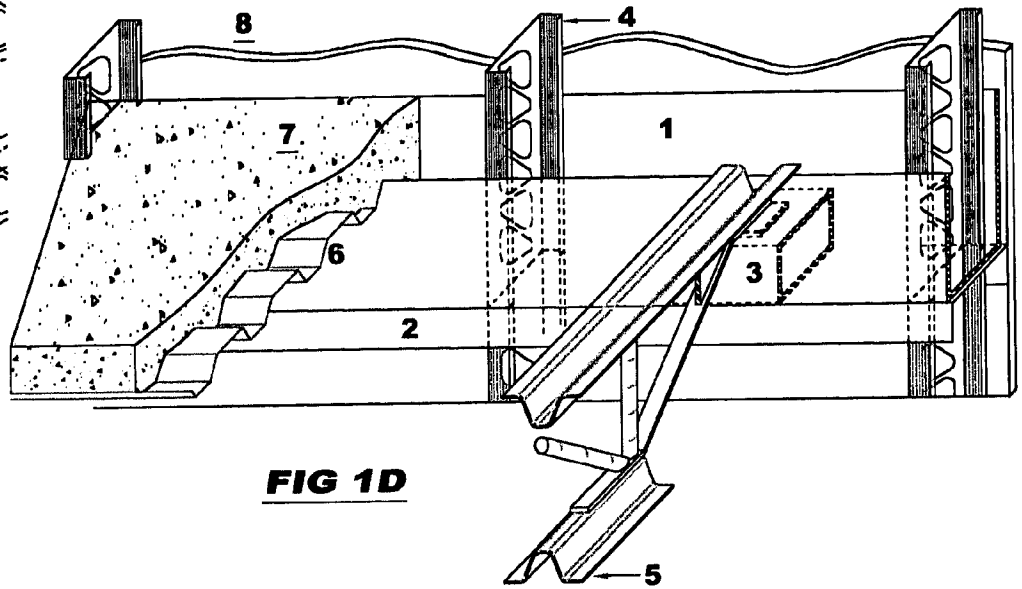
FIG. 1D shows an isometric view of a typical intermediate floor/wall joint detail comprising embodiment 1 in conjunction with the "concrete-topped steel deck on OWSJ" floor system at an exterior load-bearing wall.
Figure 1C:
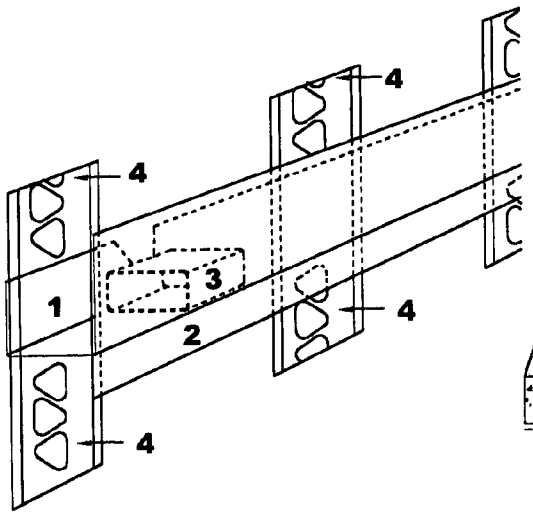

Each wall panel above the lowest level, illustrated in FIGS. 1A, 1B, and 1C, comprises:

Light gauge steel track, 100 mm deep×width of the wall studs (2);

Light gauge steel studs, with or without perforations along the length, but with at least one perforation in the web at specified location at the bottom (4);

Special bottom track, with cutouts on the inside at specified locations for OWSJ and the exterior leg extending 100 mm above top of OWSJ for concrete closure (1);

Load-bearing block (150×100 tube section shown) at cutout locations (3).

FIG. 1D illustrates how Embodiment 1 is used for the support of "concrete-topped steel deck on OWSJ" floor system. OWSJ (5) is placed on the load-bearing block (3) through the cutout in the bottom track (1). Steel deck (6) is installed on the OWSJ, but is stopped on the inside face of the exterior wall. Reinforcing bar(s) is(are) placed in the bottom track. Number and size of reinforcing bars are governed by specific project requirements: OWSJ span, floor loading, window and/or door opening size, etc. Floor concrete (7) can be scheduled after the building is enclosed, and is allowed to flow into the bottom track, forming a reinforced concrete beam inside the wall. A special feature is that the OWSJ's are located between two studs, ensuring uniform loading to the LBW.

Embodiment 2—Interior LBW for OWSJ

Embodiment 1 is modified for application in an interior load-bearing wall supporting OWSJ's from both sides. The modification is achieved by having cutouts in both vertical legs of the bottom track (9), and having both vertical legs the same height.

Figure 2B:
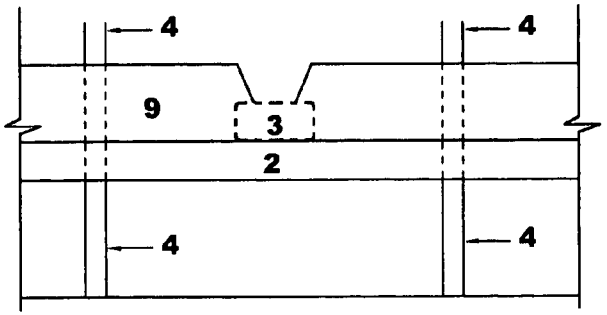
FIGS. 2A, 2B, and 2C show the sectional view, the elevation view, and the isometric view, respectively, of interior load-bearing wall panels for the support of concrete-topped steel deck on OWSJ floor assembly—hereinafter referred as embodiment 2—at a floor joint on the perimeter of a multi-storey structure.
Figure 2D:
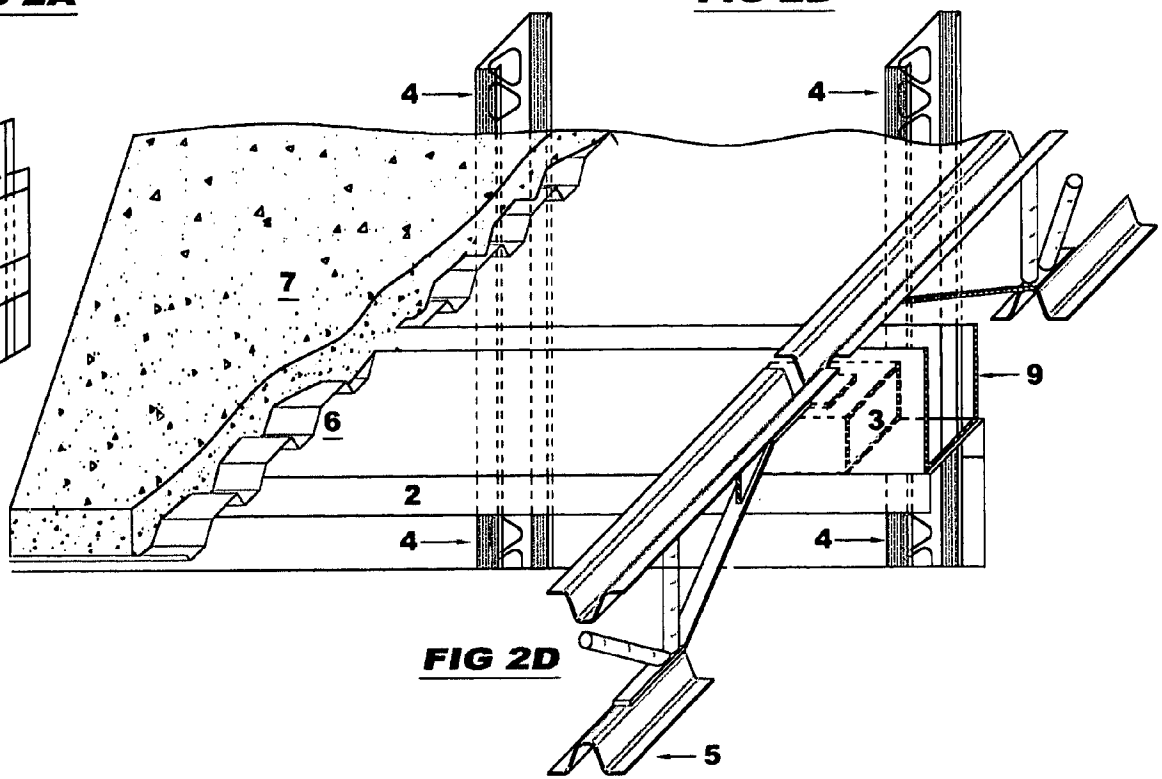
FIG. 2D shows an isometric view of a typical intermediate floor/wall joint detail comprising embodiment 2 in conjunction with the "concrete-topped steel deck on OWSJ" floor system at an interior load-bearing wall.
Figure 2A:
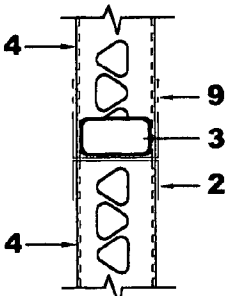
Figure 2C:
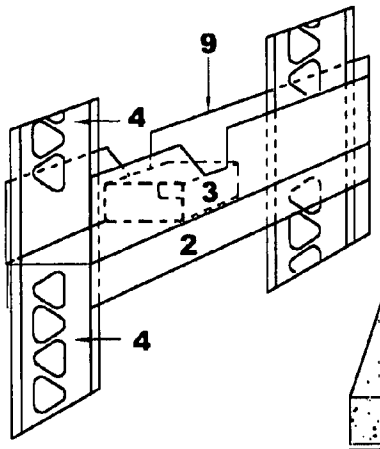

FIG. 2D illustrates how Embodiment 2 is used for the support of "concrete-topped steel deck on OWSJ" floor system. OWSJ (5) is placed on the load-bearing block (3) through the cutout in the bottom track (9). Steel deck (6) is installed on the OWSJ, but stopped on the both faces of the interior wall. Reinforcing bar(s) is(are) placed in the bottom track. Number and size of reinforcing bars are governed by specific project requirements: OWSJ span, floor loading, window and/or door opening size, etc. Floor concrete can be scheduled after the building is enclosed, and is allowed to flow into the bottom track, forming a reinforced concrete beam inside the wall.

Embodiment 3—LBW for Deep-profiled Composite Deck

The first level of a load-bearing wall structure is the conventional load-bearing wall, with light gauge steel studs placed between top and bottom tracks.

Figure 3B:
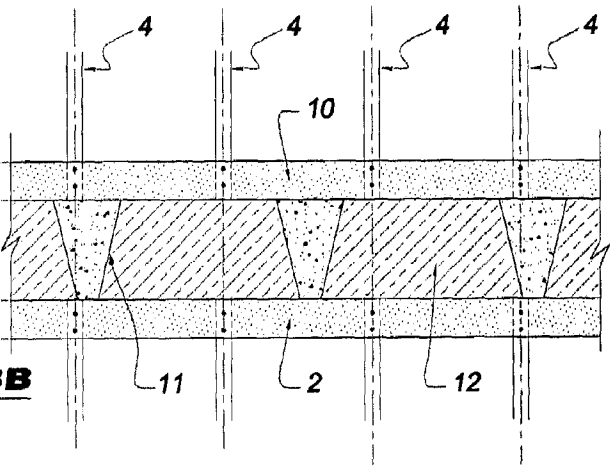
FIGS. 3A, 3B, and 3C show the sectional view, the elevation view, and the isometric view, respectively, of exterior load-bearing wall panels for the support of concrete-topped deep profile composite deck floor assembly—hereinafter referred as embodiment 3—at a floor joint on the perimeter of a multi-storey structure.
Figure 3A:
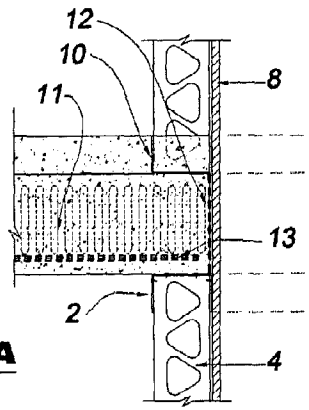
Figure 3D:
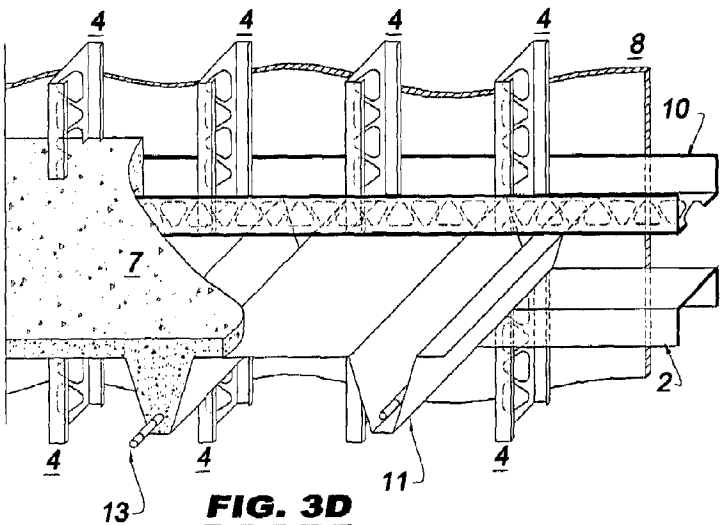
FIG. 3D shows an isometric view of a typical intermediate floor/wall joint detail comprising embodiment 3 in conjunction with the "concrete-topped deep profile composite deck" floor system at an exterior load-bearing wall.
Figure 3C:
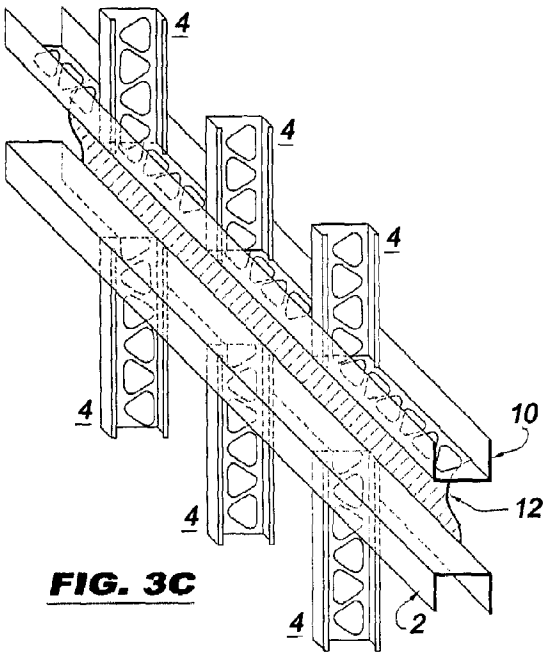

Each wall panel above the lowest level, illustrated in FIGS. 3A, 3B, and 3C, comprises:

Light gauge steel track, 100 mm deep×width of the wall studs (2);

Light gauge steel studs, with or without perforations along the length, but with at least one perforation in the web at specified location at the bottom (1);

Special bottom track, with cutouts at the bottom at locations matching the flutes of the deep-profiled composite deck and the exterior leg above top of the deep-profiled composite deck for concrete closure (10);

FIG. 3D illustrates how Embodiment 3 is used for the support of concrete-topped deep-profiled composite deck floor system. The deep-profiled composite deck (11) bears on top of the load-bearing wall below. Closure panels (12) are fitted to the deep-profile metal deckfor concrete stop. The next lift of load-bearing wall comprises web-perforated metal studs, deep bottom tracks (10) with perforations matching flutes of the deep profile deck, and a top track. The upper load-bearing panel is located such that the perforations in the bottom track match the flutes of the deep profile deck. Floor concrete can be scheduled after the building is enclosed, and is allowed to flow into the bottom track and down into the flute of the deep profile deck.

Embodiment 4—Exterior Load-Bearing Wall for Web-Perforated C-Joists

The first level of a load-bearing wall structure is the conventional load-bearing wall, with light gauge steel studs placed between top and bottom tracks.

Figure 4B:
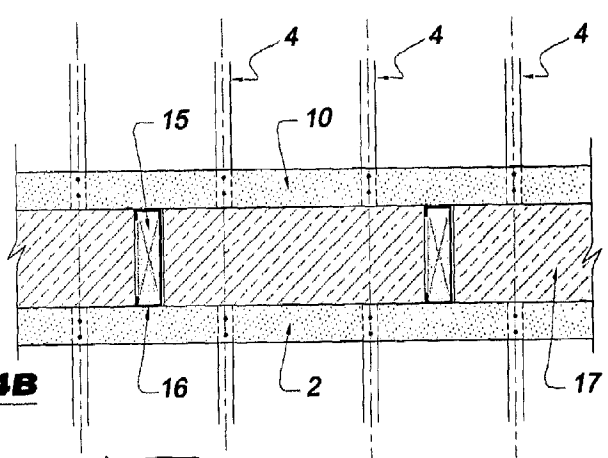
FIGS. 4A, 4B, and 4C show the sectional view, the elevation view, and the isometric view, respectively, of exterior composite beam for the support of concrete-topped steel deck on OWSJ floor assembly—hereinafter referred as embodiment 4—at a floor joint on the perimeter of a multi-storey structure.
Figure 4D:
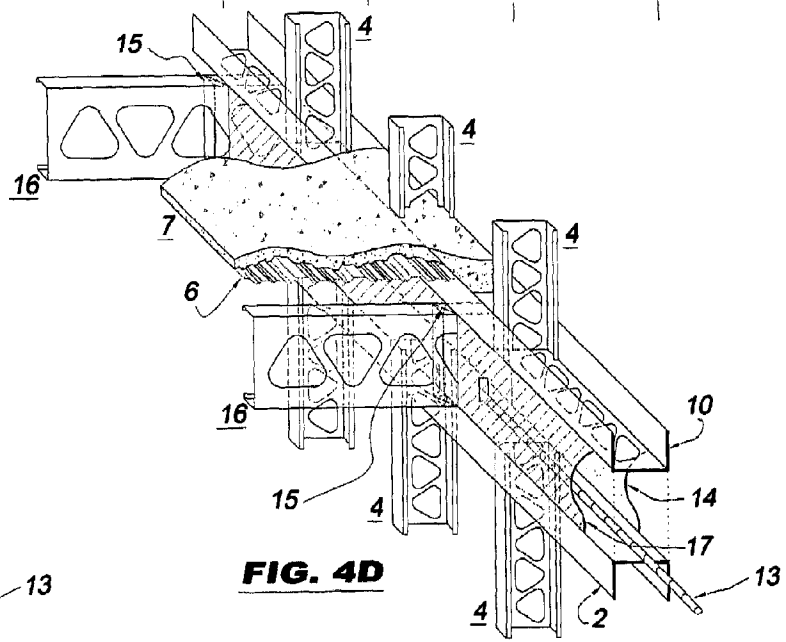
FIG. 4D shows an isometric view of a typical intermediate floor/wall joint detail comprising embodiment 4 in conjunction with the "concrete-topped steel deck" floor system and perimeter wind-bearing stud wall.
Figure 4A:
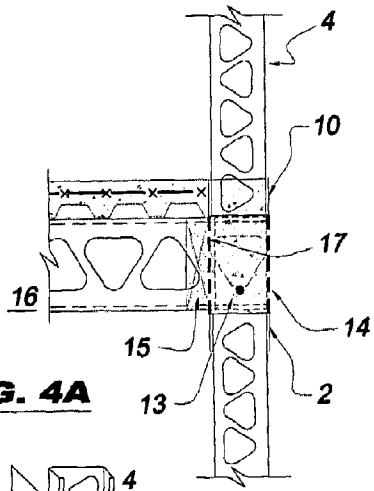
Figure 4C:
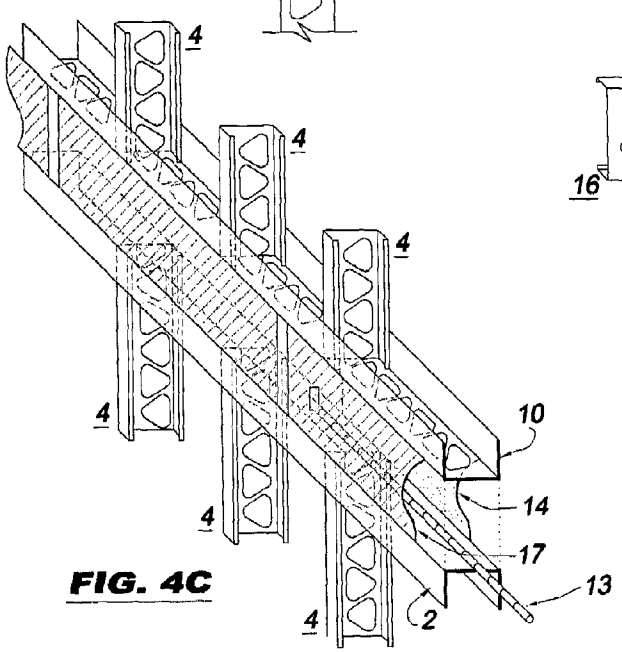

Each wall panel above the lowest level, illustrated in FIGS. 4A, 4B, and 4C, comprises:

Light gauge steel track, 100 mm deep×width of the wall studs (2);

Light gauge steel studs, with or without perforations along the length, but with at least one perforation in the web at specified location at the bottom (4);

Special bottom track, with perforations in the web (10);

Solid web rim joist doubling as exterior closure panel (14);

Closure panels at the interior between joists (17);

Blockings in the web space between flanges of the joists (15)

FIG. 4D illustrates how Embodiment 4 is used for the support of "concrete-topped web-perforated C-joists. The web-perforated C-joists (16) are placed on top of the top track below and between two studs. A continuous solid-web rim joist is fitted to stabilize the web-forated C-joists and also provide concrete closure. Steel deck (6) is installed on the C-joists, but is stopped on the inside face of the exterior wall. Reinforcing bars (13) are placed through the webs of the C-joists. Number and size of reinforcing bars are governed by specific project requirements: floor joist span, floor loading, window and/or door opening size, etc. The next lift of load-bearing wall comprises web-perforated metal studs (4), deep bottom tracks with perforations (10) and a top track (2). Interior closure panels (17) are installed at the interior face of the wall between C-joists. Blockings (15) are inserted in the web space at each C-joist. Floor concrete (7) can be scheduled after the building is enclosed, and is allowed to flow into the bottom track and down into the space formed by the closure panels and blockings, forming a reinforced concrete beam inside the wall. A special feature is that the C-joists are located between two studs, ensuring uniform loading to the LBW.

Embodiment 5—Interior Load-Bearing Wall for Web-Perforated C-Joists

The first level of a load-bearing wall structure is the conventional load-bearing wall, with light gauge steel studs placed between top and bottom tracks.

Figure 5B:
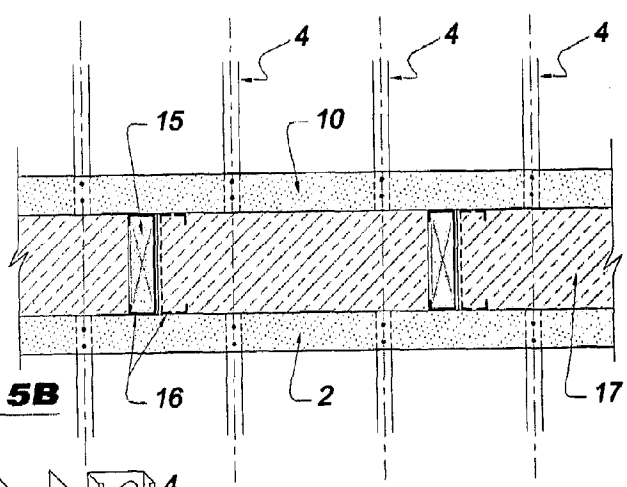
FIGS. 5A, 5B, and 5C show the sectional view, the elevation view, and the isometric view, respectively, of exterior load-bearing wall panels for the support of concrete-topped steel deck on web-perforated channel type joist floor assembly—hereinafter referred as embodiment 5—at a floor joint of a multi-storey structure.
Figure 5D:
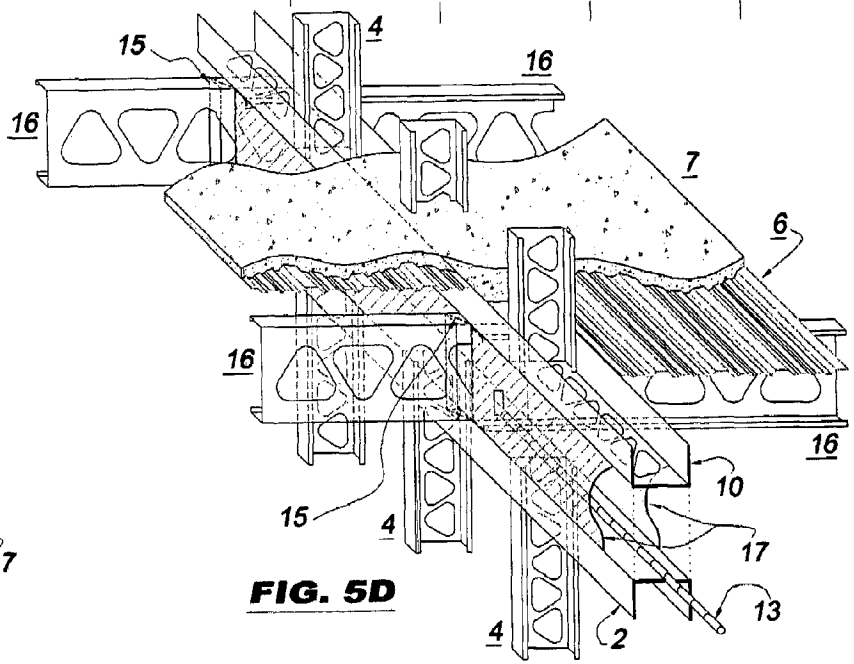
FIG. 5D shows an isometric view of a typical intermediate floor/wall joint detail comprising embodiment 5 in conjunction with the "concrete-topped steel deck on web-perforated channel type joist floor system.
Figure 5A:
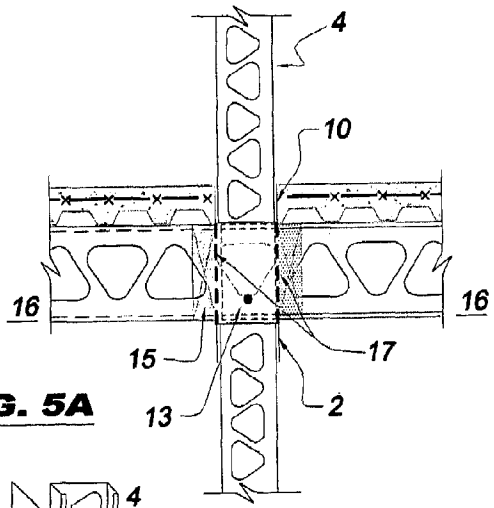
Figure 5C:
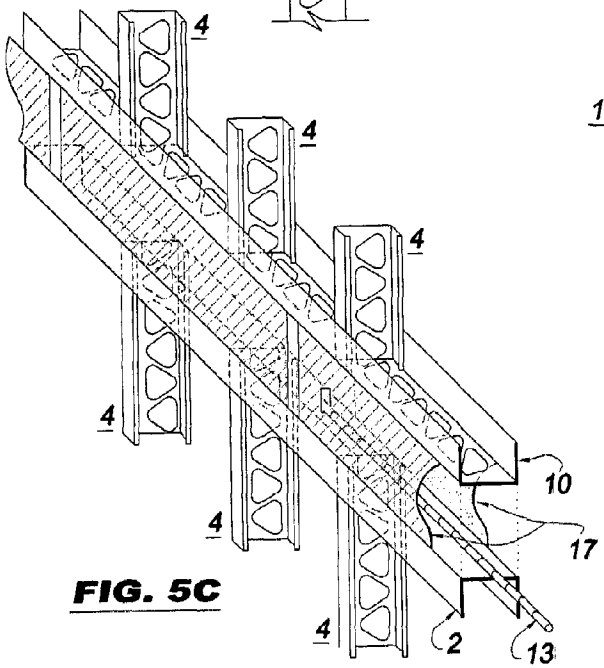

Each wall panel above the lowest level, illustrated in FIGS. 5A, 5B, and 5C, comprises:

Light gauge steel track, 100 mm deep×width of the wall studs (2);

Light gauge steel studs, with or without perforations along the length, but with at least one perforation in the web at specified location at the bottom (4);

Special bottom track, with cutouts on the at the bottom (10)

Closure panels between joists (17)

Blockings in the web space between flanges of the joists (15)

FIG. 5D illustrates how Embodiment 5 is used for the support of "concrete-topped web-perforated C-joists. The web-perforated C-joists (16) are placed on top of the top track below and between two studs. C-joists from both sides of the load-bearing wall are placed back-to-back to provide stiffening to each other. Steel deck (6) is installed on the C-joists, but is stopped on the either face of the interior wall. Reinforcing bars (13) are placed through the webs of the C-joists. Number and size of reinforcing bars are governed by specific project requirements: floor joist span, floor loading, window and/or door opening size, etc. The next lift of load-bearing wall comprises web-perforated metal studs (4), deep bottom tracks with perforations (10) and a top track (2). Closure panels (17) are installed between C-joists. Blockings (15) are inserted in the web space at each C-joist. Floor concrete (7) can be scheduled after the building is enclosed, and is allowed to flow into the bottom track and down into the space formed by the closure panels and blockings, forming a reinforced concrete beam inside the wall. A special feature is that the C-joists are located between two studs, ensuring uniform loading to the LBW.

Embodiment 6—Exterior Composite Beam & Perimeter Wall for OWSJ

The composite steel beam comprises equally spaced shear connectors (19) shop welded to the top flange of a structural beam (18), normally a wide flange beam. The beam section, and shear connector design are governed by specific project requirements: beam span, OWSJ span, and floor loading. Exterior wall panels, complete with opening framing for windows, are installed on top of the composite beam before concrete pour. Each wall panel comprises:

Light gauge steel track, 100 mm deep×width of the wall studs (2);

Light gauge steel studs, with or without perforations along the length, but with at least one perforation in the web at specified location at the bottom (4);

Special bottom track (1), with cutouts on the inside at specified locations for OWSJ, exterior leg extending 100 mm above top of OWSJ for concrete closure, and regularly spaced holes in the bottom for passage of shear connectors from the steel beam;

Load-bearing block (150×100 tube section shown) at cutout locations (3).

FIG. 6D illustrates how Embodiment 4 is used for the support of "concrete-topped steel deck on OWSJ" floor system. OWSJ (5) is placed on the load-bearing block (3) through the cutout in the bottom track (1). Steel deck (6) is installed on the OWSJ, but stopped on the inside face of the exterior wall. Floor concrete (7) can be scheduled after the building is enclosed, and is allowed to flow into the bottom track. The shear heads (19) integrate the steel beam with a deep L-shaped concrete section, ensuring an efficient composite edge beam. The encasing of the wind-bearing studs in the concrete section provides for a stiff wall assembly, a feature especially useful under wide window openings.

Embodiment 7—Interior Composite Beam for OWSJ

Figure 7B:
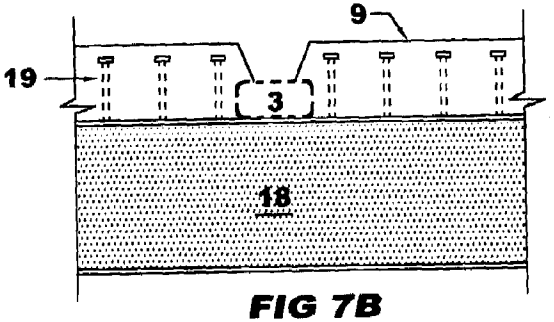
FIGS. 7A, 7B, and 7C show the sectional view, the elevation view, and the isometric view, respectively, of interior composite beam for the support of concrete-topped steel deck on OWSJ floor assembly—hereinafter referred as embodiment 7—at a floor joint of a multi-storey structure.
Figure 7D:
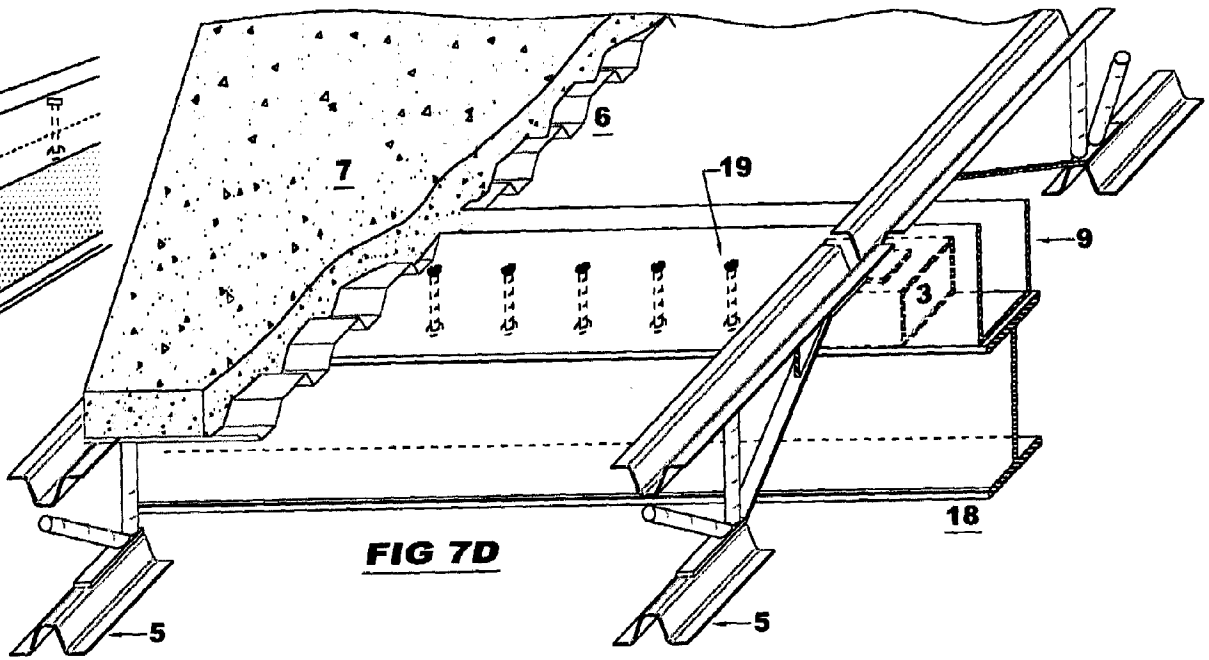
FIG. 7D shows an isometric view of a typical intermediate floor/wall joint detail comprising embodiment 7 in conjunction with the "concrete-topped steel deck" floor system.
Figure 7A:
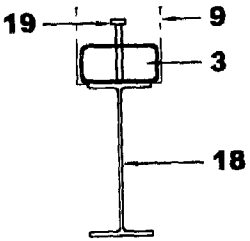
Figure 7C:
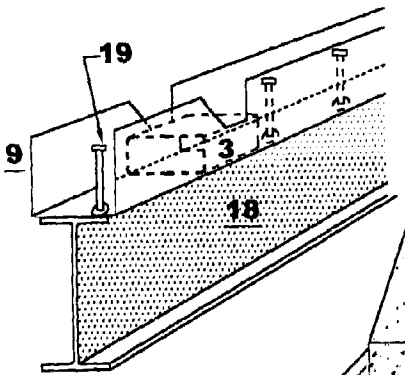
Figure 8B:
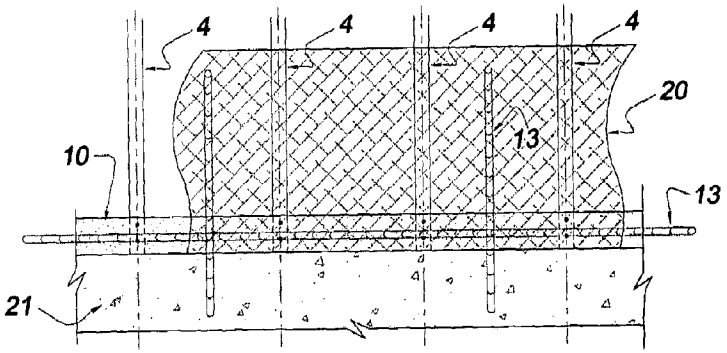
FIGS. 8A, 8B and 8C show the sectional view, the elevation view and the isometric view, respectively, of an impact-resistant perimeter metal stud wall—hereinafter referred as embodiment 8—at a perimeter wall location.
Figure 8A:
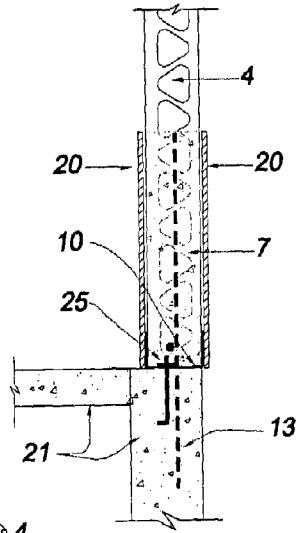
Figure 8D:
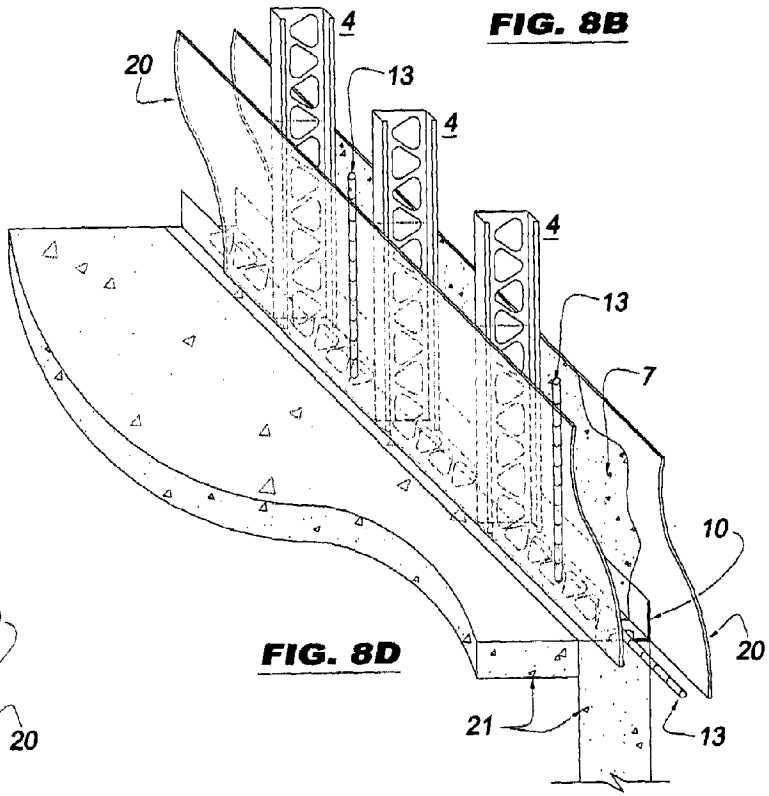
FIG. 8D shows an isometric view of a typical perimeter wall comprising embodiment 8 on top of a perimeter foundation element.
Figure 8C:
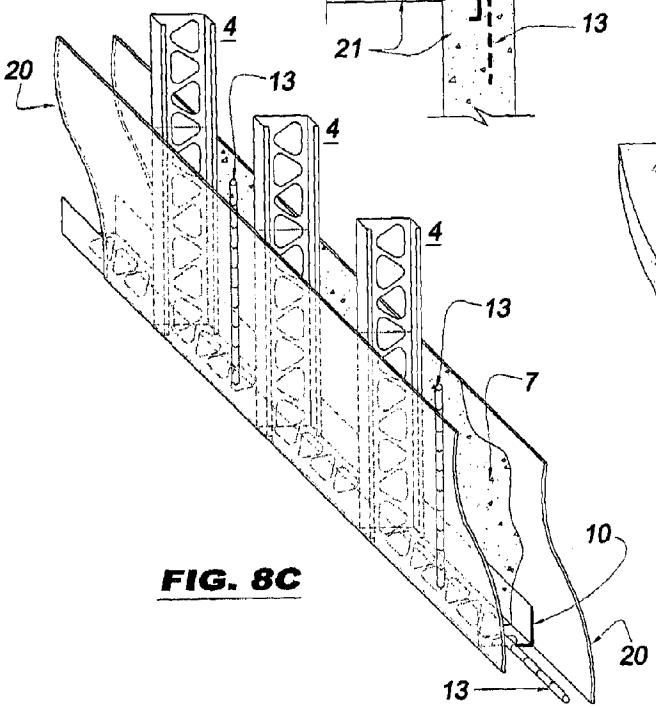

Embodiment 6 is modified for application in an interior composite beam supporting OWSJ's from both sides. The modification is achieved by having cutouts in both vertical legs of the bottom track (9), and having both vertical legs the same height. The final result is Embodiment 7, and comprises:

Steel beam (18) with shear studs (1 shop or fielded welded to project requirements, Special track with cutouts at OWSJ locations and perforations at the bottom for passage of shear stud connectors Load-bearing blocks for support of OWSJ FIG. 7D illustrates how Embodiment 7 is used for the support of "concrete-topped steel deck on OWSJ" floor system. OWSJ is placed on the load-bearing block (3) through the cutout in the bottom track (9). Steel deck (6) is installed on the OWSJ, but stopped on the both faces of the bottom track. Floor concrete (7) can be scheduled after the building is enclosed, and is allowed to flow into the bottom track. The shear heads (19) integrate the steel beam with a deep T-shaped concrete section, ensuring an efficient composite beam.

Embodiment 8—Impact-Resistant Perimeter Stud Wall

The impact-resistant perimeter stud wall is an economical perimeter wall system that protects the building and its occupants from errant vehicles running into the building, comprising:

Bottom track with perforations (10);

Web-perforated metal studs (4);

Left-in-place formwork (20)

Dowels (13) from the foundation into the wall space through the perforated bottom track Perimeter stud walls using web-perforated studs and perforated track are installed on top of the foundation element (21). Plywood or OSB boards (20) are applied on both sides of the stud wall to a height as per project requirement. Horizontal reinforcing bars (13) are installed through the perforated studs, and dowels (13) from the foundation through the perforated bottom track. Concrete is poured to the height of the formwork, producing an in-wall wheel stop.

Embodiment 9—Shear-Connection-Ready Composite Open Web Steel Joists

This new shear-connection-ready open web steel joists comprises:

Conventional open web steel joists (23) fitted with a steel cap plate;

Shear stud connectors field installed after steel deck is completed

Conventional open web steel joists are shop-fitted with a cap plate. Steel deck is installed continuously over OWSJ supports. Shear stud connectors are then connected through the steel deck to the cap plate either by welding or with power-actuated connectors.

Figure 10B:
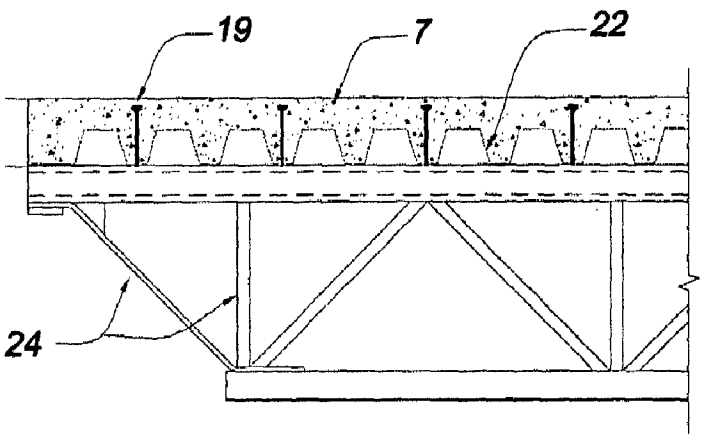
FIGS. 10A, and 10B show the sectional view and the elevation view, respectively of another interior shear-connection-ready open web steel joist—hereinafter referred as embodiment 10.
Figure 10A:
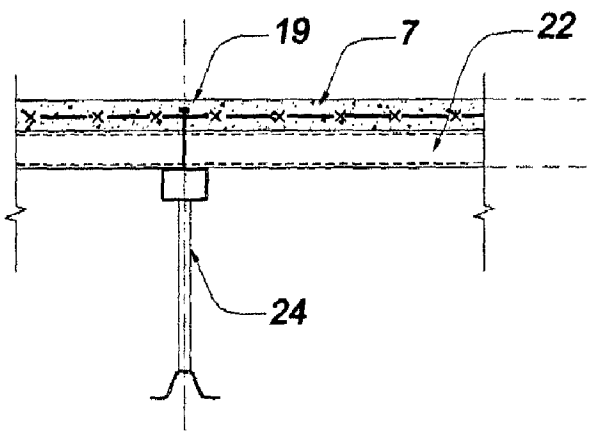

Alternately, in lieu of a steel cap plate fitted to a regular OWSJ, the top chord may be replaced with a flat-topped element, such as a T-section or a tube section as shown in FIG. 10.

For economy and adequate concrete surrounding the shear-connectors, medium profiled and wide-fluted steel decks are recommended to increase joist spacing. Typical applications will have 75 mm deep wide-fluted composite decks spanning 2400 mm or more between the shear-connection-ready OWSJ. The increased joist spacing allows the design to reduce the steel beam capacity requirement by locating the joists away from mid-span and closer to the end supports of the beam.

Fabrication/Construction Procedures

We describe below, by way of examples with a Load-bearing Wall System and a Composite Beam/OWSJ system, ways the invention may be used in the construction of a multi-storey structure.

LBW—OWSJ System

FIGS. 1D and 2D detail the typical exterior/interior floor/wall joints, respectively, comprising the invention and the steel deck on open-web-steel-joist floor system.

The wall construction is done, either on site or in a shop, in the following sequence:

(a) The first lifts of the wall panels complete with exterior sheathing are assembled. Optionally, 100 mm deep tracks (2) may be used as the top and bottom tracks.

(b) Closure Tracks (1 and 9 for exterior and interior walls, respectively) are connected to the top tracks (2) of the bearing wall panels.

(c) Load-bearing blocks (3) are installed at the cutout locations, ready to receive floor joists.

(d) Cross-bracings (as per project design) and exterior sheathing are installed.

The upper wall panels are assembled similarly, except for the following modifications:

(a) The wall panels are assembled without the bottom track;

(b) The exterior sheathing are installed to an extent from the top of the Exterior Closure Track (1) of the lower wall panel to the top of the Exterior Closure Track (1) at the top.

The complete site construction may proceed as follows:

(a) The first lifts of the wall panels, complete with the closure tracks, are installed on top of the foundation.

(b) Temporary bracings for the wall panels are installed.

(c) Open web steel joists (5) are installed.

(d) Steel deck (6) is installed.

(e) Second lifts of wall panels are slid into the Closure Tracks (1).

(f) Rebars are threaded through the perforations in the steel studs (4).

The steps (b), (c), (d), (e) and (f) are repeated until the roof deck is installed. Concrete topping may be scheduled after the entire building enclosed as one continuous pour. Alternatively, concrete for each floor may be scheduled immediately after the floor deck above is installed.

Composite Beam—OWSJ System

Site construction procedure can be summarized as follows:

1. Structural steel trade erects the post-and-beam skeletal framing and bracing.
2. A single trade follows with the installation of
   (a) Enclosure Tracks (1, 9 for exterior and interior beams, respectively) and load bearing blocks (3);
   (b) Open web steel joists (5) and steel decks (6) either field-welded or with power-actuated connection systems;
   (c) Perimeter walls
3. Repeat Step 2 for each floor.
4. General Contractor can schedule concrete pours as one continuous process after the entire building is enclosed. Alternately, concrete pour for the floor can be scheduled after installation of the perimeter walls for the floor and the steel deck for the floor above.

Comparison with Prior Art

Load Bearing Wall Systems

Since both Luedtke and de Quesada have patents for load-bearing wall systems which allow upper floor walls to proceed before pouring floor concrete, it is imperative to distinct the load-bearing wall systems in this invention (Embodiments 1 to 5) from their systems protected under their respective US patents. The following section will examine only the parts of their claims relevant to the present application—light gauge steel stud load-bearing walls and the floor assemblies they support.

Specifically, Luedtke in U.S. Pat. No. 5,881,516, "discloses building comprising a plurality of wall members comprising a plurality of metal wall members having track elements secured thereto, a plurality of bearing members having bearing surfaces projecting therefrom, and means connecting the bearing members to the track members. A multi-layer floor extends between the walls, the floor comprising a first layer having a first surface resting on the bearing surfaces such that wall axial loads do not pass through the floor construction."

The key to Luedtke invention is that metal devices projecting outside the plane of the load-bearing wall support the floor assemblies. This very premise, however, creates eccentricity in the loading, and significantly reduces the load carrying capacity of the bearing wall. In contrast, the load-bearing wall systems in this application support floor assemblies either through a continuous reinforced concrete beam inside the wall assembly (as in the case of floors with OWSJ's or web-perforated C-joists), or through direct bearing of the floor on the load-bearing wall below (as in the case with deep-profile composite decks), with little or no eccentricity.

Though not at all clear from this Claims statement, a careful examination of U.S. Pat. No. 5,881,516 will show that the patent covers load-bearing walls supporting shallow floor assemblies only, i.e. shallow to medium depth (up to 75 mm) metal deck without joist support, and metal decks on C-shaped channel joists. Refer to FIGS. 1, 2, 3, 4*a*, 4*b*, and 6 in U.S. Pat. No. 5,881,516. Compared to modern floor assemblies using OWSJ and deep profiled composite decks, these shallow floor assemblies support relatively short spans (up to 4 meters for 75 mm decks and maybe 5 meters for C-shaped channel joists). When deep floor assemblies incorporating deep profiled composite decks and/or OWSJ are used, the concept of eccentric loading to a light gauge steel stud wall will prove almost impossible.

Another distinction between this application and Luedtke's invention lies in the use of concrete inside the load-bearing wall space. Luedtke uses conventional C-studs with solid webs. Concrete is compartmentalized in between studs, and there is no possibility of putting longitudinal reinforcing bars running the length of the load-bearing wall. Consequently, concrete in the Luedtke system serves only to improve sound and floor ratings. Structurally, it adds dead load to the wall, and consequently, increases loading to the lintels over window and door openings in the wall below. In contrast, the studs in this application will have perforations at the bottom (and, optionally, along the length of the stud), allowing reinforcing bars to go through. Hence, in the load-bearing walls supporting OWSJ or web-perforated C-joists, a reinforced concrete beam can be properly designed to carry the floor load over any window or door openings, in addition to providing the improved sound and fire rating of the wall assembly. This reinforced beam eliminates the need for secondary lintels, which would still be required in Luedtke's system.

"de Quesada discloses a prefabricated system using wall panels having a combination of cold rolled light gauge sheet metal and hot rolled tubular steel. Panels are stacked one on top of each other to form vertical wall assemblies and may be welded directly with their top and bottom members or include intermediate shear connectors. Shear resistance or resistance to lateral forces is provided by a single continuous metal sheet either flat or corrugated (a deck type sheet) fastened to the steel studs or alternatively diagonal or V-shaped bracing. Connectors between the wall panels provide a gap for a continuous concrete floor."

Figure 9B:
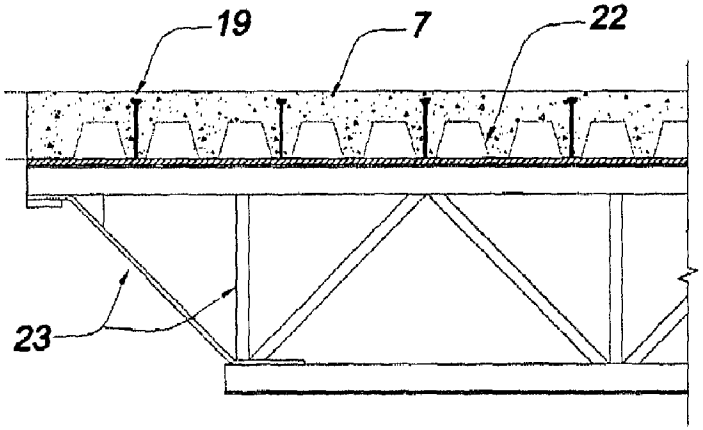
FIGS. 9A, and 9B show the sectional view and the elevation view, respectively of an interior shear-connection-ready open web steel joist—hereinafter referred as embodiment 9.
Figure 9A:
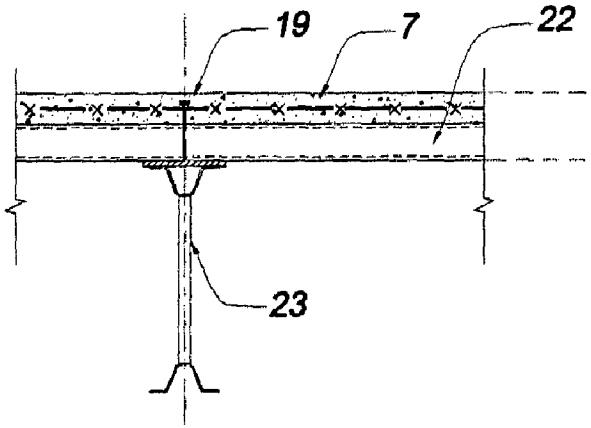

Careful examination of U.S. Pat. Nos. 6,298,617 and 5,782,047 shows that metal devices projecting outside the plane of the load-bearing wall support the floor assemblies, and only 'metal deck on C-shaped channel joists' floor assemblies are supported. Refer to FIG. 13 and FIG. 32 in U.S. Pat. No. 6,298,617 and FIGS. 8, 9, 11 in U.S. Pat. No. 5,782,047.

While continuity of the concrete in the floor assembly is maintained within the plane of the load-bearing walls to maintain continuous inter-floor fire and acoustic separation across the bearing walls, there is not enough depth of concrete for any structural use. (Refer to FIG. 13 and FIG. 32 in U.S. Pat. No. 6,298,617 and FIGS. 8, 9, 11 in U.S. Pat. No. 5,782,047.)

All the arguments that differentiate this application from Luedtke's invention apply, without modification, to de Quesada's inventions as well.

To sum up, both Luedtke and de Quesada incorporate metal devices projecting beyond the plane of load-bearing walls to carry the floor assemblies, with resulting eccentricity in loading for the load-bearing walls. Both deal with shallow floor assemblies. Luedtke deals with metal deck up to 75 mm without joist support and 'metal deck on C-shaped channel joists' floor assemblies, while de Quesada only incorporates 'metal deck on C-shaped channel joists' floor assemblies. This application uses a continuous reinforced concrete beam inside the wall assembly to carry the floor loads, with little to zero eccentricity in loading. Whereas both Luedtke and de Quesada limit their floor assemblies to shallow floor assemblies, this application extends the scope of application to deep floor assemblies with concrete topped steel deck on OWSJ and concrete on deep profile composite floor decks.

Composite Beam Systems

Rongoe (U.S. Pat. No. 4,741,138 and Canadian Patent 1,230,495) presented the first patented composite steel beam system supporting OWSJ floors. He achieved this by "providing extensions from the girder, through the decking and into the concrete, in an assembly utilizing girders, standard joists bearing on top of the girders, and metal decking onto which concrete is poured. The extensions are located in between open web steel joists." The shear headed studs are field welded to the extensions through holes cut in the steel deck.

This method of construction involves field-cutting of holes in the steel deck, and field welding of shear stud connectors to the girder extension. In normal "concrete-topped steel deck on OWSJ" floor construction, the cover concrete thickness (the concrete above the top of the steel deck) is only about 65 mm (2.5 inches), severely limiting the effectiveness of the shear stud connectors. Consequently, a large number of shear connectors on long girder extensions are required for effective composite action, reducing the cost efficiency of the system.

In this invention, an elevated shoe is provided for the joist seats through the use of a load-bearing block, and shear stud connectors can be shop-welded to the steel beam for better quality control. No field cutting is required. The shear stud connectors are fully embedded in concrete for its maximum effectiveness. The steel beam is effectively integrated with a deep concrete beam (a T-section for interior beam, and L-section for an exterior beam) instead of a 65 mm concrete cover thickness.

Impact-Resistant Perimeter Stud Wall System

There appears to be no prior art involving perimeter stud wall system that incorporates an in-wall wheel stop.

Shear-Connection-Ready Open Web Steel Joist System

In patented prior art involving composite open web steel joists for gravity loading, all inventors have used steel shelves outside the vertical plane of the web to carry steel decks between joists. Composite action is achieved by embedding the top chord member(s) in the concrete cover slab. Various prior patents differ in the shape and/or embossment of the top chord to achieve composite action.

As steel deck is cut to fit between composite OWSJ, continuity of the steel deck is not maintained. Two connections per flute per joist location are required whereas only one connection per flute is required for deck on non-composite OWSJ.

In contrast, this invention claims a shear-connection-ready OWSJ, instead of a composite OWSJ. By fitting a cap plate to a conventional open web steel joist, steel deck may be installed continuously over joist supports and with only one connection per flute per joist location. Composite action is then achieved through field-welded shear stud connectors or power-actuated shear connectors.

As the cap plate can be fitted to any kind of top chord, this method is easily adaptable to any kind of OWSJ, and does not require major change in joist manufacturer's equipment or shop practice. The cap plate also ensures that the field-installed shear connectors can be installed centrally in the plane of the web of the joist.

Alternately, in lieu of a steel cap plate fitted to a regular OWSJ, the top chord may be replaced with a flat-topped element, such as a T-section or a tube section as shown in FIG. 10.

What is claimed is:

1. A wall-and-floor assembly comprising:

(a) a wall constructed upon a support surface and comprising:

a.1 an elongate light-gauge metal base track comprising a continuous web member having an inner face and an outer face, a continuous first flange, and a continuous second flange, wherein said first and second flanges are parallel and extend substantially perpendicularly from the inner face of the web member, and wherein the first flange has a plurality of cutouts, each shaped to receive a structural joist, said base track being positioned upon and anchored to the support surface, with its first and second flanges projecting vertically upward;

a.2 a plurality of joist-support elements, each positioned upon the inner face of the base track's web member adjacent a corresponding joist cutout; and a.3 a wall panel comprising a plurality of spaced, light-gauge metal studs, the lower ends of said studs being supported by the base track;

(b) a plurality of primary floor joists each having:

b.1 a first end disposed within one of the joist cutouts in the base track's first flange, and supported on a corresponding joist-support element; and b.2 a second end supported on a first auxiliary support structure, such that the top surfaces of the primary joists lie in a common horizontal plane;

(c) metal decking overlying and fastened to the primary joists; and (d) concrete topping placed over the metal decking and extending into the space between the first and second flanges of the base track, with the upper surface of the concrete topping being at a selected floor elevation.

2. The wall-and-floor assembly of claim 1 wherein the upper edge of the base track's second flange coincides with a selected floor elevation.

3. The wall-and-floor assembly of claim 1 wherein the web of at least one of the studs has a perforation positioned below the upper edge of the base track's second flange.

4. The wall-and-floor assembly of claim 1 wherein at least one of the joist support elements is a rectilinear steel tube section.

5. The wall-and-floor assembly of claim 1 wherein the support surface is the top track of a lower wall.

* * * * *